US006966634B2

(12) United States Patent
Hsu et al.

(10) Patent No.: US 6,966,634 B2
(45) Date of Patent: Nov. 22, 2005

(54) INK SUPPLY STRUCTURE FOR INKJET PRINTHEAD

(75) Inventors: Chi-Chung Hsu, Ilan Hsien (TW); Chen-Hua Lin, Yunlin Hsien (TW); Ming-Hsun Yang, Taipei (TW)

(73) Assignee: Nanodynamics Inc., Hsinchu (TW)

( * ) Notice: Subject to any disclaimer, the term of this patent is extended or adjusted under 35 U.S.C. 154(b) by 0 days.

(21) Appl. No.: 10/724,890

(22) Filed: Dec. 2, 2003

(65) Prior Publication Data

US 2004/0109042 A1 Jun. 10, 2004

Related U.S. Application Data

(62) Division of application No. 10/213,076, filed on Aug. 7, 2002, now Pat. No. 6,682,177.

(30) Foreign Application Priority Data

Aug. 28, 2001 (TW) ..... 90121111 A

(51) Int. Cl.[7] ..... B41J 2/05
(52) U.S. Cl. ..... 347/63; 347/65; 347/94
(58) Field of Search ..... 347/63–65, 20, 347/44, 47, 56, 61, 67, 93–94

(56) References Cited

U.S. PATENT DOCUMENTS

| | | | | |
|---|---|---|---|---|
| 4,882,595 | A | 11/1989 | Trueba et al. | |
| 5,198,834 | A | 3/1993 | Childers et al. | |
| 5,308,442 | A | 5/1994 | Taub et al. | |
| 6,499,835 | B1 * | 12/2002 | Chee et al. | 347/63 |

* cited by examiner

*Primary Examiner*—Juanita D. Stephens
(74) *Attorney, Agent, or Firm*—Birch, Stewart, Kolasch & Birch, LLP

(57) ABSTRACT

A printhead includes a silicon substrate, a first barrier layer, a second barrier layer, and a nozzle plate. The silicon substrate has a plurality of thermal elements and a main ink supply channel, each of the thermal elements being in a firing chamber of the first barrier layer and in fluid communications with the main ink supply channel through ink channels. The top of each ink firing elements is aligned with a nozzle on the nozzle plate. To satisfy the need for high-frequency ink ejection, the second barrier layer is utilized to provide an auxiliary ink supply channel for increasing the ink supply speed. The ink channel between the main ink supply and the ink channel inlet is enlarged in the vertical direction so as to lower the pressure and thus increase the ink supply speed.

6 Claims, 6 Drawing Sheets

INK SUPPLY STRUCTURE FOR INKJET PRINTHEAD

This application is a Divisional of application Ser. No. 10/213,076, filed on Aug. 7, 2002, now U.S. Pat. No. 6,682,177, the entire contents of which are hereby incorporated by reference and for which priority is claimed under 35 U.S.C. § 120; and this application claims priority of Application No. 090121111 filed in Taiwan, R.O.C. on Aug. 28, 2001 under 35 U.S.C. § 119.

BACKGROUND OF THE INVENTION

1. Field of Invention

The invention relates to a printhead for inkjet printers and, in particular, to an inkjet printhead structure that has an internal fast ink supply design.

2. Related Art

The widely accepted inkjet chips are either thermal or piezoelectric. Owing to the competition among similar products, researchers are forced to make further improvement and progress in order to make the latest products satisfy new needs, including the inkjet speed and quality. Such things rely on breakthroughs in the new structure design and the material development.

To increase the inkjet speed, one also has to increase the allowable inkjet frequency. The printing quality depends upon the improvement in the ink density. However, it is found that each time an ink droplet is ejected out of a nozzle, roughly 400 $\mu$s is needed for new ink to replenish from the ink channel and for the impact to settle down. This phenomenon in turn affects the inkjet energy controls on the next ejection or nearby nozzle ejections, causing instability in the inkjet quality. Researchers further find that such replenish impact induces cross-talks among nearby nozzles. Making the ink channel long and thin may reduce such cross-talks. For example, the ink channel disclosed in the U.S. Pat. No. 4,882,595 uses exactly this idea to ease the replenish impact within 400 $\mu$s.

Although the long and thin ink channel design helps reducing cross-talks among adjacent nozzles, nevertheless, they are not completely avoided. On the other hand, the channel pressure is considerably reduced to slow down the ink supply speed, resulting in worse printing quality and lower inkjet frequency.

To prevent the pressure-lowering problem due to the long and thin ink channel, the U.S. Pat. No. 5,308,442 shortens the ink channel and forms a dipped area between the edge of the main ink supply channel and the ink channel. The border of the dipped area is close to the inlet of the ink channel so that ink can be supplied more quickly.

The invention provides an auxiliary ink supply channel so that more ink can be supplied at a closer distance to the inlet, making the ink supply speed faster.

SUMMARY OF THE INVENTION

It is an objective of the invention to provide the structure of an auxiliary ink supply channel so that more ink can be stored at a closer distance to the inlet of the ink channel, thereby lowering the pressure and making the ink supply speed faster. The disclosed structure of a printhead includes a silicon substrate, a first barrier layer, a second barrier layer, and a nozzle plate. The silicon substrate has a plurality of thermal elements and a main ink supply channel, each of the thermal elements being in an firing chamber of the first barrier layer and in fluid communications with the main ink supply channel through ink channels. The top of each ink firing elements is aligned with a nozzle on the nozzle plate. To satisfy the need for high-frequency ink ejection, the invention utilizes the second barrier layer so that ink has a larger channel provided in the perpendicular direction due to the auxiliary ink supply channel. More ink can gather at a closer distance to the inlet of the ink channel, making the ink supply speed faster.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will become more fully understood from the detailed description given hereinbelow and the accompanying drawings, which are given by way of illustration only, and thus are not limitative of the present invention, and wherein.

DETAILED DESCRIPTION OF THE INVENTION

Figure 1:
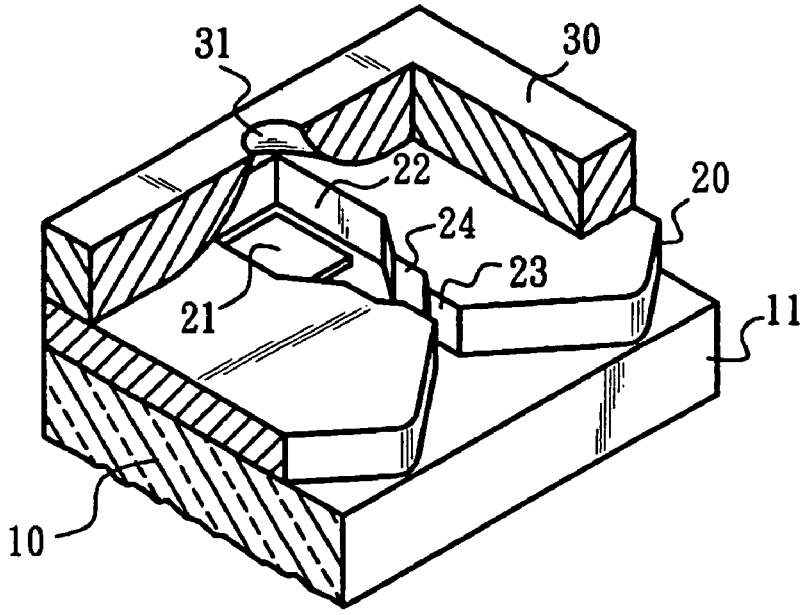
FIG. 1 (PRIOR ART)
FIG. 1 is the 3D cross-sectional view of a printhead ink supply structure in the prior art.

With reference to FIG. 1, the known printhead and its ink supply structure includes a silicon substrate 10, a first barrier layer 20 and a nozzle plate 30. The first barrier layer 20 has a plurality of firing chambers 22, each of which contains a thermal element 21 formed on the silicon substrate 10. The thermal element 21 can heat up the ink inside the firing chamber 22 and form thermal bubbles, the force of which ejects the ink. On the silicon substrate 10, there is a slot penetrating through the substrate as the main ink supply channel. The main ink supply channel leads to the ink cartridge of the printhead for the ink to flow from the main ink supply channel edge 11 through the ink channel inlet 23 into the firing chamber 22. When the ink is heated by the thermal element 21, it is ejected out of the nozzles 31 on the nozzle plate 30. To reduce the interference of the firing energy between adjacent firing chambers 22 or nozzles 31, the ink channel is designed as in the prior art to be long and thin. However, the long and thin channel often has too large a pressure to supply ink in time. To prevent this problem, the invention proposes to make the middle section 24 of the ink channel wider to reduce the pressure. Thus, the printhead can both avoid cross-talks and supply ink quickly.

Figure 2:
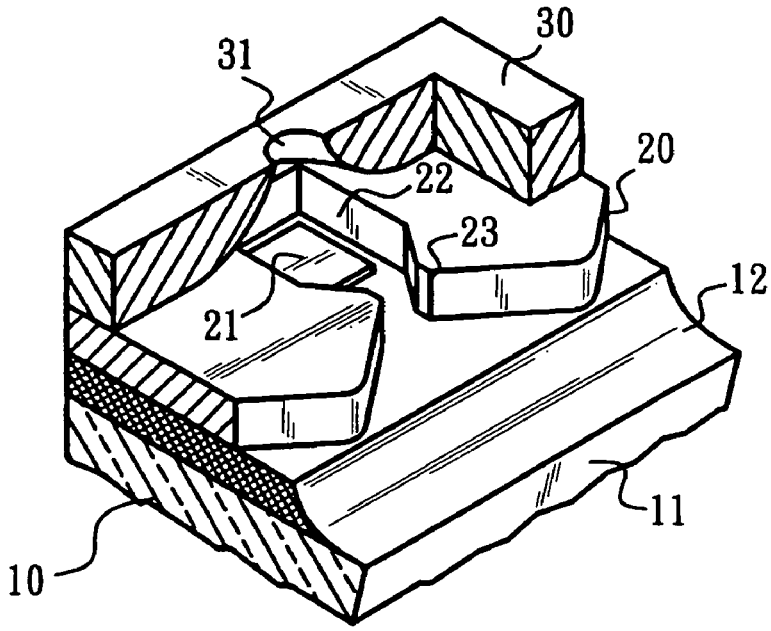
FIG. 2 (PRIOR ART)
FIG. 2 is the 3D cross-sectional view of another printhead ink supply structure in the prior art.

FIG. 2 shows another known printhead and ink supply structure. It is also comprised of a silicon substrate 10, a barrier layer 20, and a nozzle plate 30. The barrier layer 20 is formed with a plurality of firing chambers 22, each of which contains a thermal element 21 formed on the silicon substrate 10. The thermal element 21 can heat up the ink inside the firing chamber 22 and form thermal bubbles, the force of which ejects the ink. On the silicon substrate 10, there is a slot penetrating through the substrate as the main ink supply channel. The main ink supply channel leads to the ink cartridge of the printhead for the ink to flow from the main ink supply channel edge 11 through the ink channel inlet 23 into the firing chamber 22. The difference of this structure from the previous one is that the ink channel is shorter, and a surface dipped area 12 is provided between the main ink supply channel edge 11 and the ink channel inlet 23. The main purpose of this design is to reduce the pressure drop between the main ink supply channel edge 11 and the ink channel inlet 23 so that more ink can be stored by the ink channel inlet 23 in advance. Once the pressure drop along the ink supply path is decreased, the ink supply speed naturally becomes faster.

The firing chambers 22 and the nozzles 31 are not necessarily disposed in straight lines. The pattern shown in FIG. 3 does not have a fixed distance from the surface dipped area 12 to the ink channel inlet 23. This implies that the ink supply speeds between adjacent firing chambers 22 may be different.

First Embodiment

Figure 3:
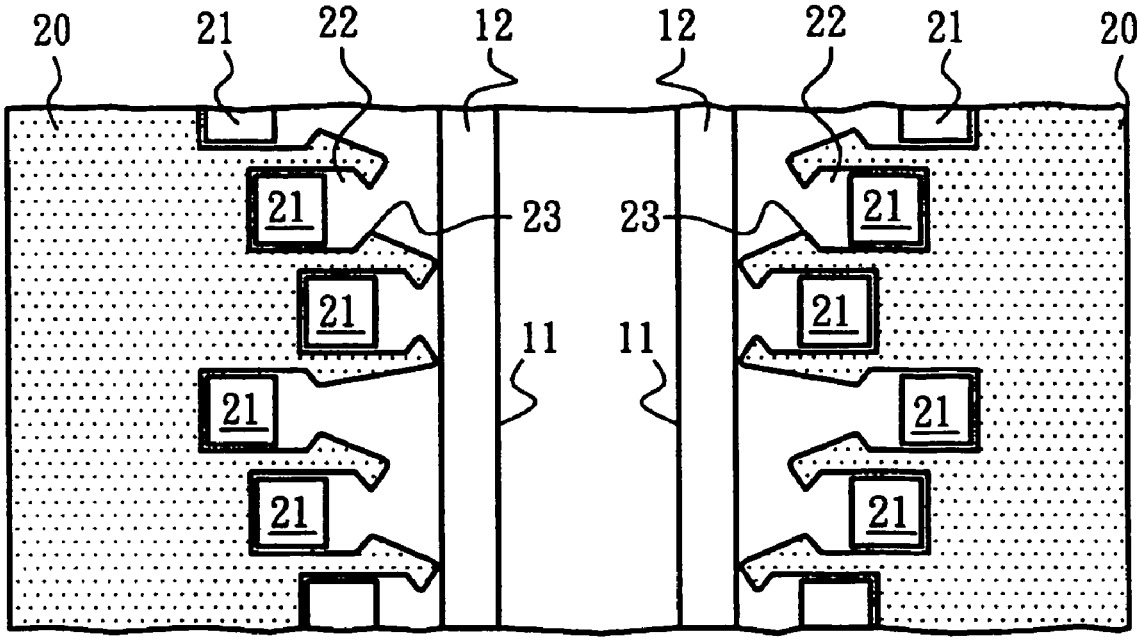
FIG. 3 (PRIOR ART)
FIG. 3 is a schematic view of the barrier layer profile of a printhead ink supply structure in the prior art.
Figure 4:
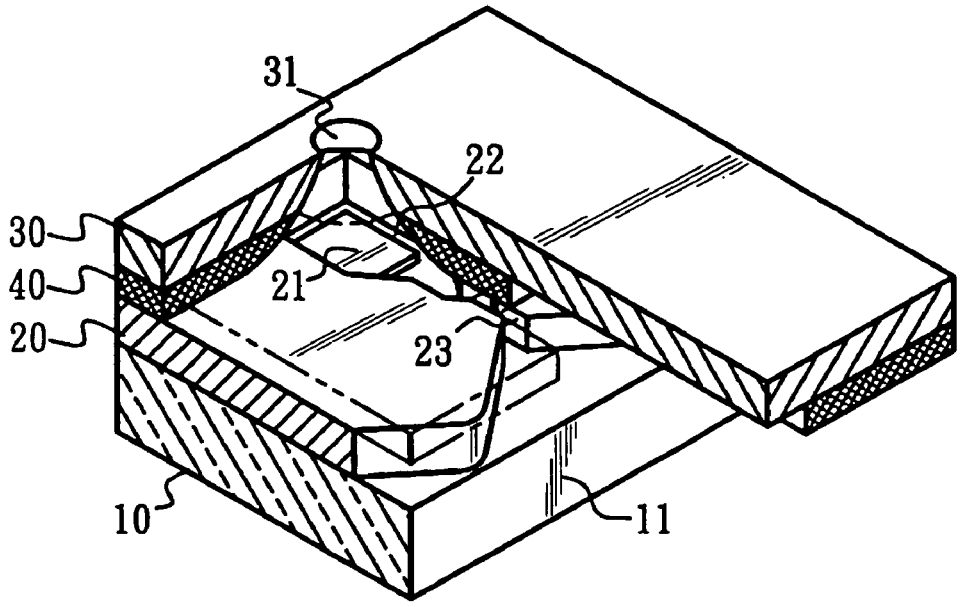
FIG. 4 is a 3D cross-sectional view of the first embodiment of the invention.
Figure 5:
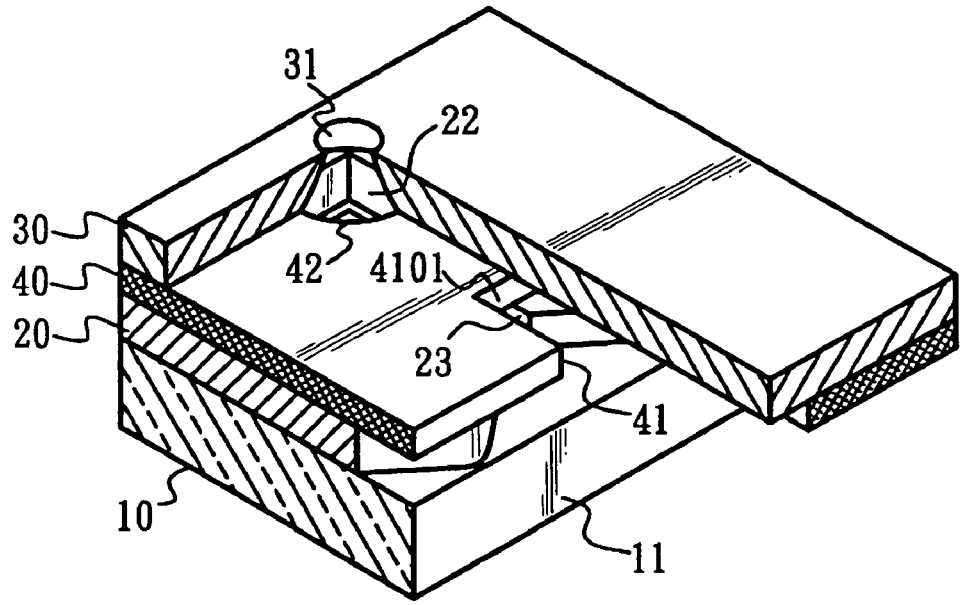
FIG. 5 is another 3D cross-sectional view of the first embodiment.

To speed up ink supply and to avoid the pattern shown in FIG. 3, the invention provides a new ink supply structure shown in FIGS. 4 and 5. The structure includes a silicon substrate 10, a first barrier layer 20, a second barrier layer 40, and a nozzle plate 30. The first barrier layer 20 is formed with a plurality of firing chambers 22, each of which contains a thermal element 21 formed on the silicon substrate 10. The thermal element 21 can heat up the ink inside the firing chamber 22 and form thermal bubbles, the force of which ejects the ink. The second barrier layer 40 has an auxiliary ink supply channel 41 connecting the main ink supply channel to the outer side of the ink channel inlet 23. One end 4101 of the auxiliary ink supply channel 41 ends near the upper and outer side of the ink channel inlet 23. Moreover, the second barrier layer 40 is formed with a hole 42 at the position corresponding to the nozzle 31, so that the ink enters the hole 42 and ejects out of the nozzle 31.

The silicon substrate 10 has a slot penetrating through the substrate to form its main ink supply channel, which leads to the ink cartridge of the printhead. The ink is thus able to flow from the main ink supply channel edge 11 through the ink channel inlet 23 into the firing chamber 22. When the ink is heated by the thermal element 21, it is ejected out of the nozzle 31 on the nozzle plate 30. New standby ink is then supplied from the main ink supply channel. At the moment, part of the ink flows from the end 4101 of the auxiliary ink supply channel 41 into the firing chamber 22.

Figure 6:
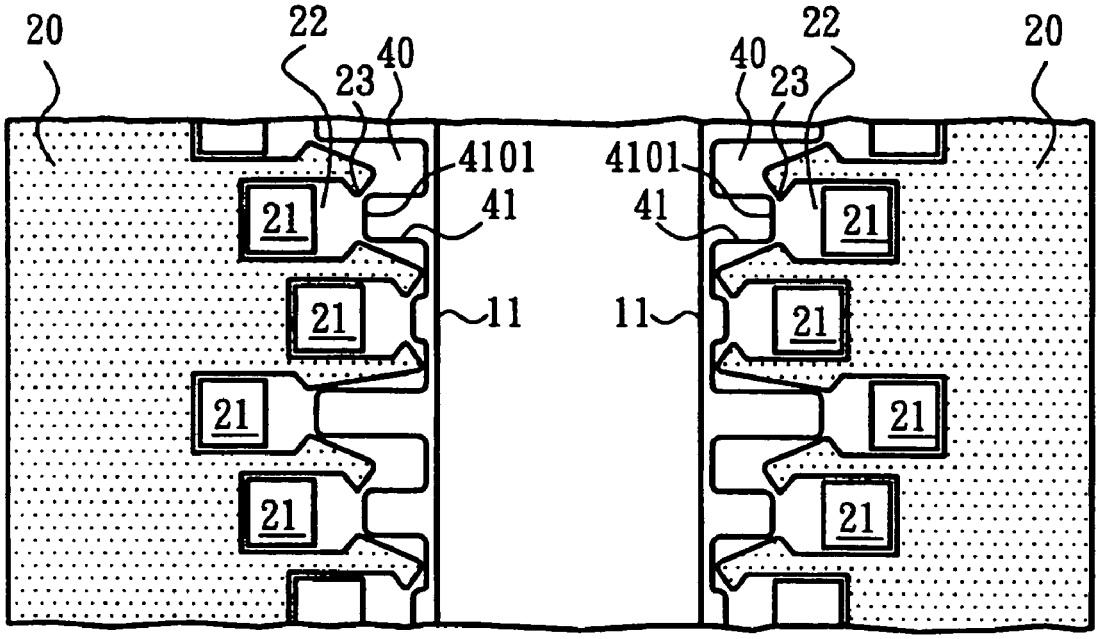
FIG. 6 is a schematic view of the barrier layer profile of the first embodiment.
Figure 7:
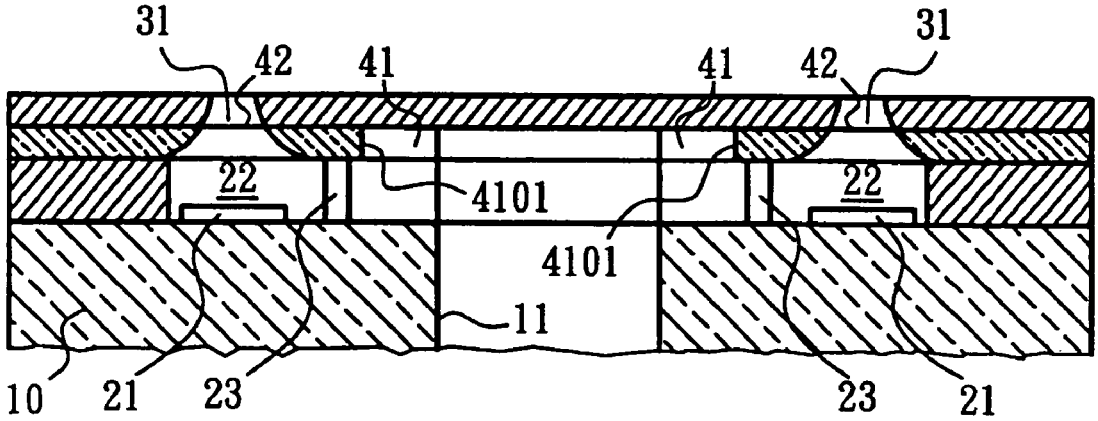
FIG. 7 is a schematic cross-sectional view of the first embodiment.

With reference to FIGS. 6 and 7, the auxiliary ink supply channel 41 can individually extends to the outer side of each of the ink channel inlets 23 to quickly supply ink in accord with the invention. Comparing the known structure in FIG. 3 and the invention shown in FIGS. 6 and 7, one can easily see that the disclosed structure allows a smoother and quicker ink supply.

Second Embodiment

Figure 8:
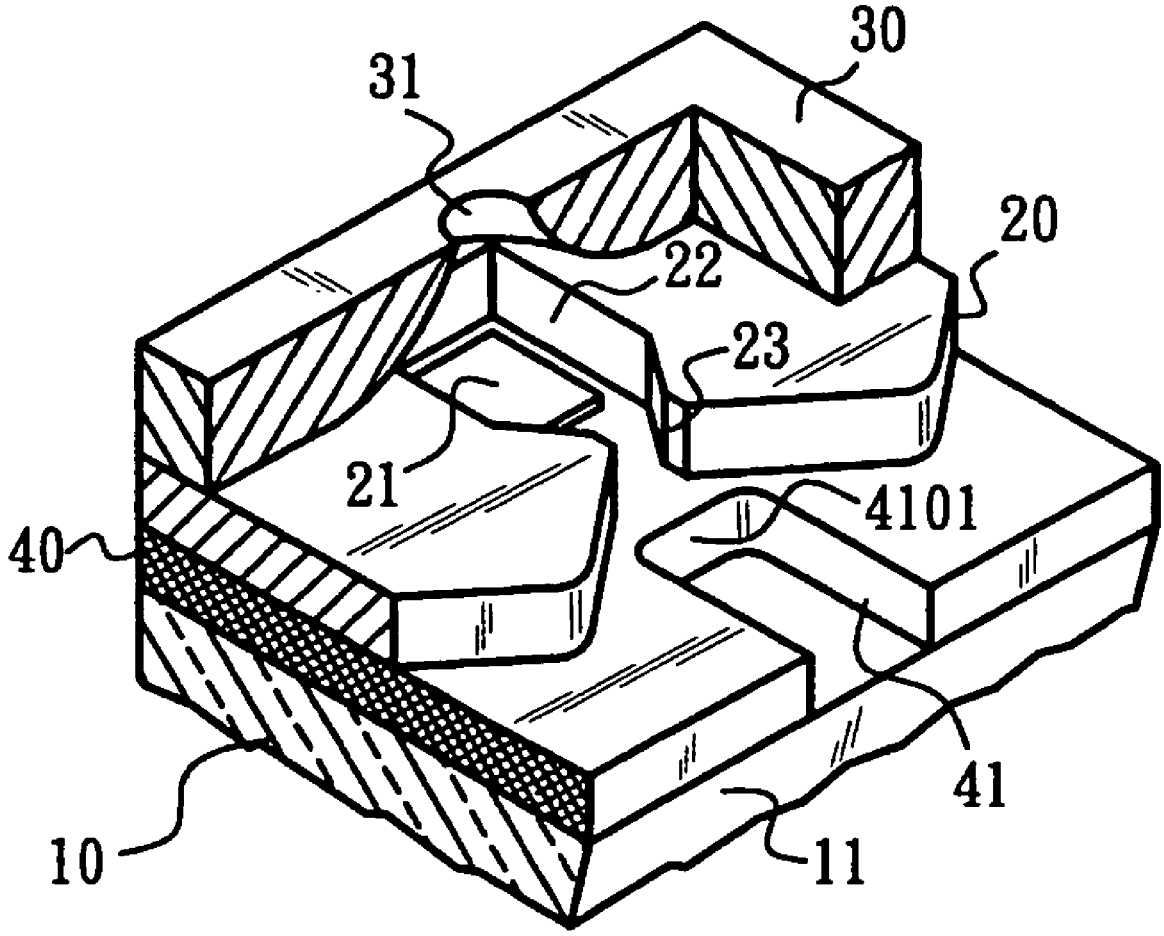
FIG. 8 is a 3D cross-sectional view of the second embodiment of the invention.

As shown in FIG. 8, the second barrier layer 40 can be installed under the first barrier layer 20. The auxiliary ink supply channel 41 leads the ink to the lower and outer side of the ink channel inlet 23.

In summary, the invention utilizes the second barrier layer 40 to provide an auxiliary ink supply channel 41 to provide a large ink flux in the perpendicular direction, so that more ink can be closely stored near the ink channel inlet. This structure can effectively reduce the pressure drop and increase the ink supply speed and the upper limit of the ejection frequency. If the opening of the ink channel is further restricted to minimize the span between adjacent nozzles 31, then the ejection point density and printing quality can be increased.

Figure 9:
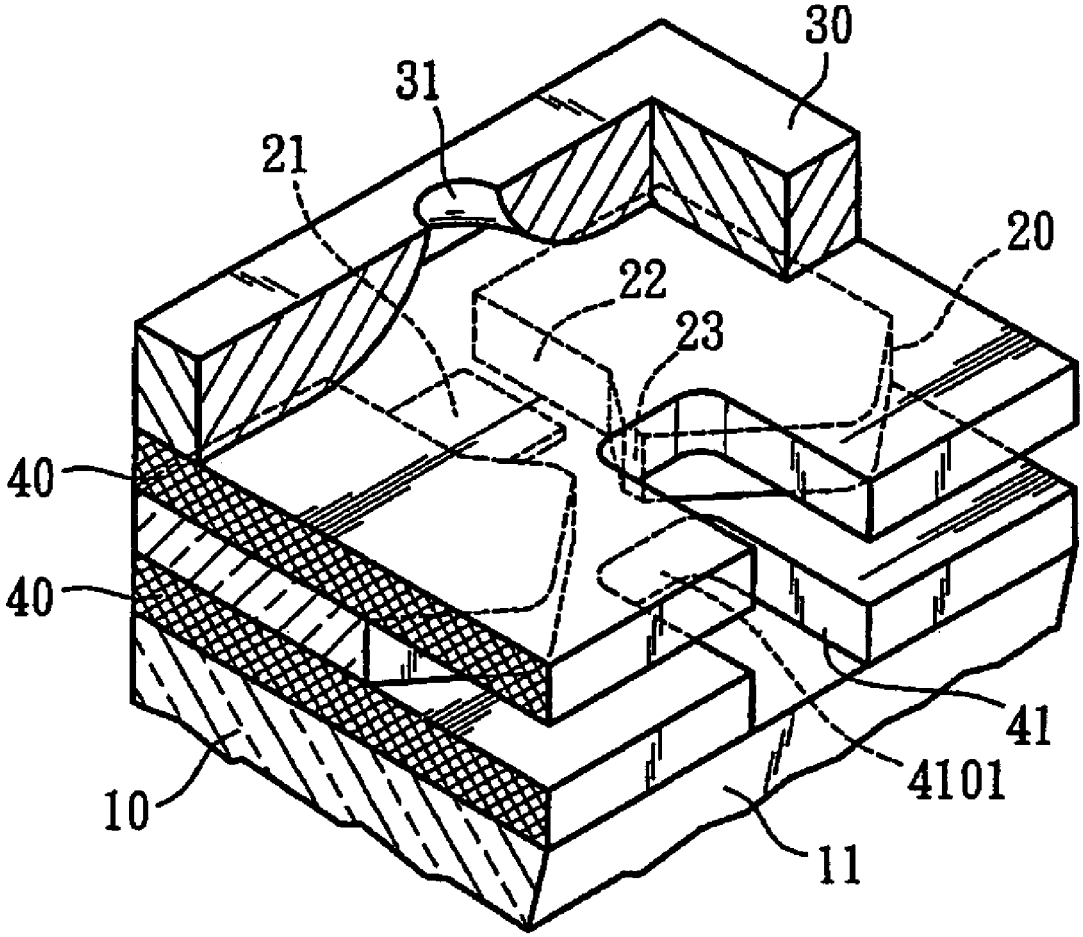
FIG. 9 is a 3-D cross-sectional view of the third embodiment of the invention.

Although the invention has been described with reference to specific embodiments, this description is not meant to be construed in a limiting sense. Various modifications of the disclosed embodiments as well as alternative embodiments, will be apparent to persons skilled in the art. For example, the main ink supply channel can be moved to the side of the silicon substrate. The upper and lower sides of the first barrier layer 20 can be each provided with a second barrier layer, forming a pair of auxiliary ink supply channels 41 and thus providing a larger cross section for ink flow in the vertical direction, as shown in FIG. 9. This can further reduce the pressure drop along the ink path and increase the ink supply speed and ejection frequency. It is, therefore, contemplated that the appended claims will cover all modifications that fall within the true scope of the invention.

What is claimed is:

1. A printhead ink supply structure comprising:

a silicon substrate having a plurality of thermal elements and a main ink supply channel, and the main ink supply channel connecting to an ink cartridge of the printhead;

a first barrier layer having a plurality of firing chambers installed at positions corresponding to the thermal elements and a plurality of ink channels connected to the firing chambers and the main ink supply channel by inlets;

a second barrier layer having a plurality of slots extending from the main ink supply channel to the inlets of the ink channels to form auxiliary ink supply channels, the second barrier layer at least partially covers the ink chamber; and a nozzle plate covering the first barrier layer and the second barrier layer, having a plurality of nozzles installed at positions corresponding to the firing chambers, wherein the first barrier layer is located at one of between the nozzle plate and the second barrier layer, or over the second barrier layer.

2. The printhead ink supply structure of claim 1, wherein the second barrier layer has a plurality of holes at positions corresponding to the nozzles.

3. A printhead ink supply structure comprising:

a silicon substrate having a plurality of thermal elements and a main ink supply channel, and the main ink supply channel connecting to an ink cartridge of the printhead;

a first barrier layer having a plurality of firing chambers installed at positions corresponding to the thermal elements and a plurality of ink channels connected to the firing chambers and the main ink supply channel by inlets;

a second barrier layer provided on the upper and lower sides of the first barrier layer, each having a plurality of slots extending from the main ink supply channel to the inlets of the ink channels, the second barrier layer at least partially covers the ink chamber; and a nozzle plate covering the first barrier layer or the second barrier layer and having a plurality of nozzles installed at positions corresponding to the firing chambers.

4. The printhead ink supply structure of claim 3, wherein each of the slots end on another side of the inlet of one of the ink channels.

5. The printhead ink supply structure of claim 3, wherein the slots of the second barrier layer terminate at the inlets of the ink channels.

6. The printhead ink supply structure of claim 3, wherein the inlets of the ink channels are adjacent the ink chamber.

* * * * *